US007938516B2

(12) United States Patent
Piatt et al.

(10) Patent No.: US 7,938,516 B2
(45) Date of Patent: May 10, 2011

(54) CONTINUOUS INKJET PRINTING SYSTEM AND METHOD FOR PRODUCING SELECTIVE DEFLECTION OF DROPLETS FORMED DURING DIFFERENT PHASES OF A COMMON CHARGE ELECTRODE

(75) Inventors: Michael J. Piatt, Dayton, OH (US); Randy L. Fagerquist, Fairborn, OH (US)

(73) Assignee: Eastman Kodak Company, Rochester, NY (US)

( * ) Notice: Subject to any disclaimer, the term of this patent is extended or adjusted under 35 U.S.C. 154(b) by 453 days.

(21) Appl. No.: 12/187,613

(22) Filed: Aug. 7, 2008

(65) Prior Publication Data

US 2010/0033543 A1 Feb. 11, 2010

(51) Int. Cl.
*B41J 2/02* (2006.01)

(52) U.S. Cl. ..... 347/73

(58) Field of Classification Search ..... 347/73, 347/74–79, 80–89, 90

See application file for complete search history.

(56) References Cited

U.S. PATENT DOCUMENTS

| | | | | |
|---|---|---|---|---|
| 3,709,432 | A | 1/1973 | Robertson | |
| 4,318,481 | A | 3/1982 | Lombardo et al. | |
| 4,321,609 | A | 3/1982 | Fidler et al. | |
| 4,338,613 | A | 7/1982 | Cruz-Uribe | |
| 4,346,387 | A | 8/1982 | Hertz | |
| 4,364,057 | A | 12/1982 | Ebi et al. | |
| 4,596,990 | A | 6/1986 | Hou | |
| 4,839,665 | A | 6/1989 | Hertz et al. | |
| 5,001,497 | A | 3/1991 | Wills et al. | |
| 5,070,341 | A | 12/1991 | Wills et al. | |
| 5,434,609 | A | 7/1995 | Rhodes | |
| 5,489,929 | A | 2/1996 | Vago | |
| 5,491,362 | A | 2/1996 | Hamzehdoost et al. | |
| 6,012,805 | A | 1/2000 | Hawkins et al. | |
| 6,109,739 | A | 8/2000 | Stamer et al. | |
| 6,217,163 | B1 | 4/2001 | Anagnostopoulos et al. | |
| 6,247,801 | B1 | 6/2001 | Trauernicht et al. | |
| 6,273,559 | B1 | 8/2001 | Vago et al. | |
| 6,508,532 | B1 | 1/2003 | Hawkins et al. | |
| 6,509,917 | B1 | 1/2003 | Chwalek et al. | |
| 6,520,629 | B1 | 2/2003 | Sharma et al. | |
| 2003/0085964 | A1 | 5/2003 | Long | |
| 2004/0263585 | A1 | 12/2004 | Jeanmaire | |
| 2007/0064067 | A1 * | 3/2007 | Katerberg | 347/74 |
| 2008/0284827 | A1 * | 11/2008 | Fagerquist et al. | 347/77 |

FOREIGN PATENT DOCUMENTS

| | | |
|---|---|---|
| EP | 0 521 764 | 6/1995 |
| JP | 57 201668 A | 12/1982 |

* cited by examiner

*Primary Examiner* — K. Feggins
(74) *Attorney, Agent, or Firm* — William R. Zimmerli

(57) ABSTRACT

A continuous inkjet system includes a plurality of nozzles producing a respective liquid jet through each nozzle. A stimulation device at each nozzle is responsive to different types of stimulation signals to produce a modulation in the respective liquid jet to selectively control droplet break off relative to phases of the cycle of a varying voltage source that is connected to a charge electrode. The break off phase of a droplet relative to the voltage phase of the voltage source will determine whether the droplet is charged or not charged. Droplets that become charged may be deflected from their paths and a deflection mechanism including the charge electrode determines which droplets are allowed to reach a surface for say printing and which droplets are collected and not deposited upon the surface.

20 Claims, 9 Drawing Sheets

CONTINUOUS INKJET PRINTING SYSTEM AND METHOD FOR PRODUCING SELECTIVE DEFLECTION OF DROPLETS FORMED DURING DIFFERENT PHASES OF A COMMON CHARGE ELECTRODE

CROSS REFERENCE TO RELATED APPLICATIONS

Reference is made to commonly assigned co-pending U.S. patent application Ser. No. 12/187,593 filed in the name of Piatt et al and entitled "Continuous Inkjet Printing System and Method for Producing Selective Deflection of Droplets Formed From Two Different Break Off Lengths" and filed concurrently herewith.

FIELD OF THE INVENTION

The present invention relates to the field of continuous inkjet printing systems and methods. Specifically, the invention is for an apparatus and method for selectively generating droplets that are formed during different phases of a common charge electrode and selectively deflecting droplets formed by an inkjet printhead in accordance with the charges the droplets acquire at different phases of the common electrode.

BACKGROUND OF THE INVENTION

Continuous inkjet (CIJ) printing systems create printed materials by forcing ink, under pressure, through a nozzle. The flow of ink may be disrupted in a manner such that the flow breaks up into droplets of ink in a predictable manner. Printing occurs through the selective deflecting and catching of undesired ink droplets. In U.S. Pat. No. 6,273,559 filed in the names of Vago et al. there are described continuous inkjet printing techniques one of which is referred to as the binary continuous inkjet technique. In the binary continuous inkjet technique electrically conducting ink is pressurized and discharged through a calibrated nozzle and the ink jets formed are broken off at two different time intervals. Droplets to be printed or not printed are created with periodic stimulation pulses at a nozzle. The droplets to be printed are each created with a periodic stimulation pulse that is relatively strong and causes the ink jet stream forming that droplet to separate at a relatively short break off length. The droplets that are not to be printed are each created with a periodic stimulation pulse that is relatively weak and causes the droplet to separate at a relatively long break off length. Electrodes are positioned just downstream of the nozzle and provide a charge to each droplet that is formed. The longer break off length droplets are selectively deviated from their path by a deflection device because of their charge and are deflected by the deflection device towards a catcher surface where they are collected in a gutter and returned to a reservoir for reuse.

The binary CIJ printheads may be operable in a manner such that the liquid jets may be said to have associated therewith a wavelength □ that is the distance between successive ink droplets or ink nodes in that liquid jet. The wavelength, λ, is equal to the speed of the jet divided by the frequency of the stimulation signals, assuming one stimulation signal at each nozzle during a stimulation cycle It is thus possible to modulate the liquid jets break off points such that there exist a first and a second liquid break off points such that the break off points differ by a distance measured related to this wavelength. For example, in the aforementioned Vago et al. patent the longer and shorter break off length droplets have a distance between two jet break off points of less than λ. The longer break off length droplets have a break off point or droplet formation point d2 that is spaced from the location d1 where the shorter break off length droplets form by a distance less than λ. In Vago et al. there is mention made of prior art wherein the delta difference between d2 and d1 is λ and that this creates problems when there is a transition at a nozzle from creation of a longer break off length droplet followed by a shorter break off length droplet. The problem recognized by Vago et al. is that of the tendency of the longer break off length droplet and the shorter break off length droplet to simultaneously detach; i.e. two droplets break off from the jet concurrently. Where the delta difference is slightly greater than λ the two droplets may temporarily be combined and alter the trajectory of the droplets. There is thus the suggestion by Vago et al. to avoid the use of having droplet separation distance differences between the longer break off length droplets and shorter break off length droplets be greater than or equal to λ. To this end the specification of Vago et al. is directed to the teaching of using a significantly smaller break off separation distance between the longer break off length droplets and the shorter break off length droplets.

To enable droplet selection based on such small break off length differences as taught by Vago et al. it is necessary to establish electric fields having a sharp gradient along the jet trajectory. Vago et al. is able to achieve these high gradients by utilizing two sets of charge electrodes that were closely spaced along the drop trajectory. One of the electrode pairs was biased at +300 volts relative to the drop generator and the second electrode pair biased to −300 volts relative to the drop generator. To alter the break off length locations as described in the Vago et al. specification requires two stimulation amplitudes (a print and a non-print stimulation amplitude) to be employed. Limiting the break off length locations difference to less than λ restricts the stimulation amplitudes difference that must be used to a small amount. For a printhead that has only a single jet, it is quite easy to adjust the position of the electrodes, the voltages on the charging electrodes, and print and non-print stimulation amplitudes to produce the desired separation of print and non-print droplets. However, in a printhead having an array of nozzles parts tolerances can make this quite difficult. The need to have a high electric field gradient in the droplet breakoff region makes the drop selection system sensitive to slight variations in charging electrode flatness, electrode thicknesses, and spacings that can all produce variations in the electric field strength and the electric field gradient at the droplet breakoff region for the different liquid jets in the array. As a result of such variations it can be quite difficult to adequately separate print and non-print droplets from the different nozzles in the array so that the non-print droplets can be caught even if the droplet generator and the associated stimulation devices were perfectly uniform down the nozzle array. But of course the droplet generator and the associated stimulation devices are not perfectly uniform down the nozzle array, but instead require different stimulation amplitudes from nozzle to nozzle to produce particular break off lengths These problems are compounded by ink properties that drift over time, and thermal expansion that can cause the charging electrodes to shift and warp with temperature. In such systems extra control complexity is required to adjust the print and non-print stimulation amplitudes from nozzle to nozzle to ensure the desired separation of print and non-print droplets.

It is therefore an object of the invention to overcome the aforesaid deficiencies by providing a common charge electrode that has a time varying electrical potential. This allows, as will be shown below, for less complexity in control of signals to the stimulation devices at the nozzles. This further enables the use of less complex charge electrode structures and larger spacing between the charge electrode structures and the nozzles.

SUMMARY OF THE INVENTION

In accordance with a first aspect of the invention there is provided a continuous inkjet system for selectively depositing liquid droplets upon a surface, the system comprising a liquid chamber including a nozzle, the liquid chamber containing liquid under pressure sufficient to produce a liquid jet through the nozzle. A source of varying electrical potential has a periodicity providing cycles each having a relatively high-voltage phase and a relatively low-voltage phase. A stimulation device is operatively associated with the liquid jet. The stimulation device is responsive to respective different types of stimulation signals and operable to produce a modulation in the liquid jet to selectively control droplet break off relative to phases of the cycle of the source. A first liquid droplet from the liquid jet has a first break off phase relative to a cycle of the source and a second liquid droplet from the liquid jet has a second break off phase relative to a cycle of the source. The first break off phase and the second break off phase have a difference such that the first break off phase coincides with the relatively high-voltage phase and the second break off phase coincides with the relatively low-voltage phase. A deflection mechanism includes a charge electrode electrically connected to the source of varying electrical potential. The charge electrode is operable to produce a charge differential between the first liquid droplet and the second liquid droplet. The deflection mechanism is operable to cause trajectories of the first liquid droplet and the second liquid droplet to diverge so that a trajectory of one droplet of the first and second liquid droplets causes the one droplet to be directed for collection and prevented from depositing on the surface and a trajectory of the other droplet of said first and second liquid droplets causes the other droplet to be directed for depositing upon the surface and wherein the electrical potential on the charge electrode varies with said periodicity and is independent of types of stimulation signals used to determine whether a droplet is to travel in accordance with the trajectory of the first liquid droplet or the trajectory of the second liquid droplet.

In accordance with a second aspect of the invention there is provided a continuous inkjet droplet generating method for selectively depositing liquid droplets upon a surface, the method comprising producing a liquid jet through a nozzle and providing a charge electrode connected to a source of varying electrical potential having a periodicity providing cycles each having a relatively high-voltage phase and a relatively low-voltage phase. A stimulation device associated with the liquid jet is operated to produce a modulation in the liquid jet to selectively control droplet break off relative to phases of the cycle of the source wherein a first liquid droplet from the liquid jet has a first break off phase relative to a cycle of the source and a second liquid droplet from the liquid jet has a second break off phase relative to a cycle of the source. The first break off phase and the second break off phase having a difference such that the first break off phase coincides with the relatively high-voltage phase and the second break off phase coincides with the relatively low-voltage phase. The charge electrode operates to produce a charge differential between the first liquid droplet and the second liquid droplet and droplets are selectively deflected to cause trajectories of the first liquid droplet and the second liquid droplet to diverge so that a trajectory of one droplet of the first and second liquid droplets causes the one droplet to be directed for collection and prevented from depositing on the surface and a trajectory of the other droplet of said first and second liquid droplets causes the other droplet to be directed for depositing upon the surface. The electrical potential on the charge electrode varies with said periodicity and is independent of types of stimulation signals used to determine whether a droplet is to travel in accordance with the trajectory of the first liquid droplet or the trajectory of the second liquid droplet.

These and other objects, features and advantages of the present invention will become apparent to those skilled in the art upon reading of the following detailed description when taken in conjunction with the drawings wherein there is shown and described illustrative embodiments of the invention.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
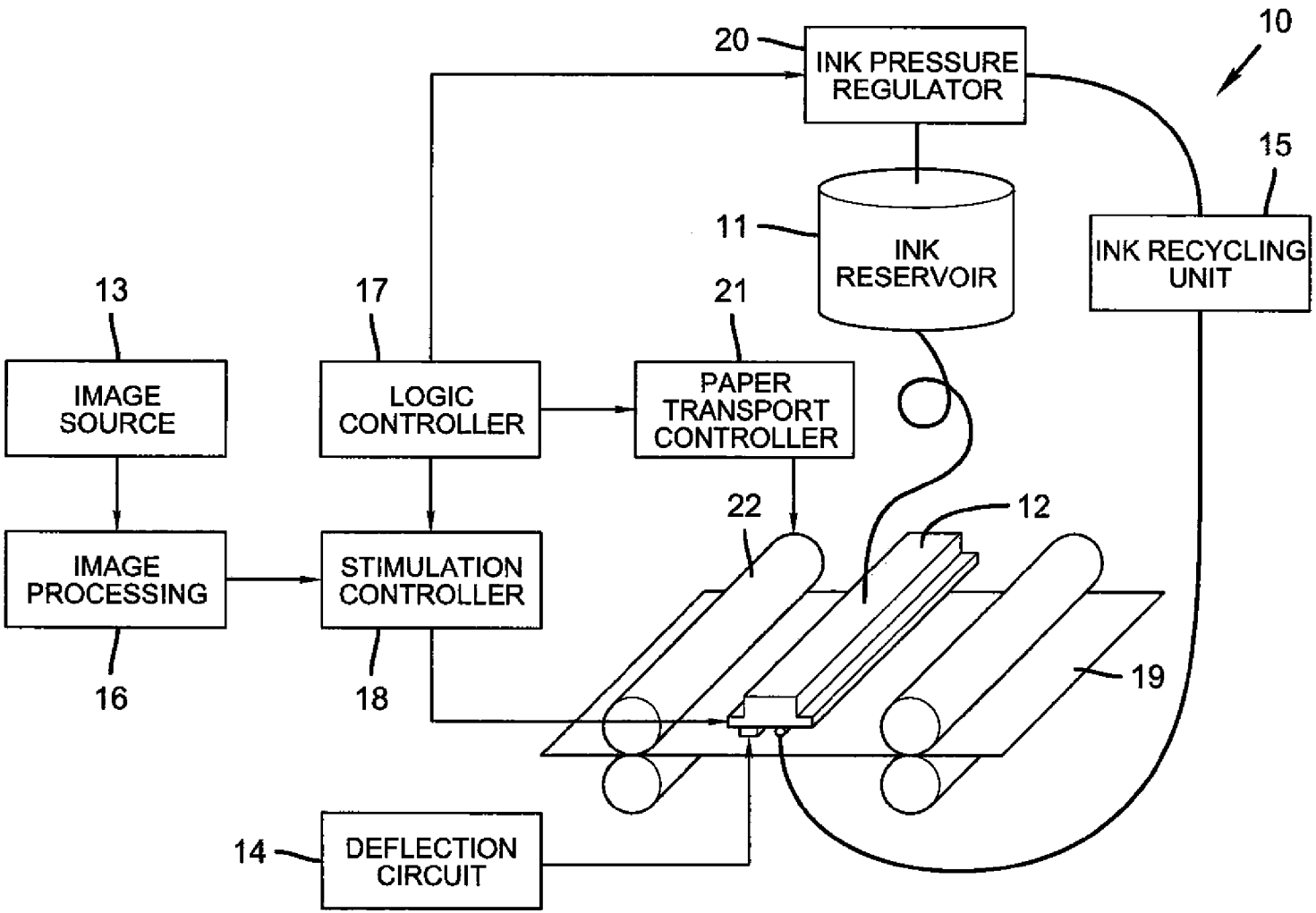
FIG. 1 is a simplified block schematic diagram of one exemplary continuous inkjet printing system according to the present invention.

A continuous inkjet printing system 10 as illustrated in FIG. 1 comprises an ink reservoir 11 that continuously pumps ink into a printhead 12 to create a continuous stream of ink droplets. Printing system 10 receives digitized image process data from an image source 13 such as a scanner, or digital camera or computer or other source of digital data which provides raster image data, outline image data in the form of a page description language, or other forms of digital image data. The image data from the image source 13 is sent periodically to an image processor 16. Image processor 16 processes the image data and includes a memory for storing image data. Image data in image processor 16 is stored in image memory in the image processor 16 and is sent periodically to a droplet or stimulation controller 18 which generates patterns of time-varying electrical stimulation pulses to cause a stream of droplets to form at the outlet of each of the nozzles on printhead 16, as will be described. The image processor 16 is typically a raster image processor (RIP). These stimulation pulses are applied at an appropriate time and at an appropriate frequency to stimulation device(s) associated with each of the nozzles. The printhead 12 and deflection mechanism 14 works sequentially in order to determine whether ink droplets are printed on a recording medium 19 in the appropriate position designated by the data in image memory or deflected and recycled via the ink recycling units 15. The ink in the ink recycling units 15 is directed back into the ink reservoir 11. The ink is distributed under pressure to the back surface of the printhead 12 by an ink channel that includes a chamber or plenum formed in a silicon substrate. Alternatively, the chamber could be formed in a manifold piece to which the silicon substrate is attached. The ink preferably flows from the chamber through slots and/or holes etched through the silicon substrate of the printhead 12 to its front surface, where a plurality of nozzles and stimulation devices are situated. The ink pressure suitable for optimal operation will depend on a number of factors, including geometry and thermal properties of the nozzles and thermal and fluid dynamic properties of the ink. The constant ink pressure can be achieved by applying pressure to ink reservoir 11 under the control of ink pressure regulator 20.

One well-known problem with any type inkjet printer, whether drop-on-demand or continuous flow, relates to dot positioning. As is well-known in the art of inkjet printing, one or more droplets are generally desired to be placed within pixel areas (pixels) on the receiver, the pixel areas corresponding, for example, to pixels of information comprising digital images. Generally, these pixel areas comprise either a real or a hypothetical array of squares or rectangles on the receiver, and printer droplets are intended to be placed in desired locations within each pixel, for example in the center of each pixel area, for simple printing schemes, or, alternatively, in multiple precise locations within each pixel areas to achieve half-toning. If the placement of the droplet is incorrect and/or their placement cannot be controlled to achieve the desired placement within each pixel area, image artifacts may occur, particularly if similar types of deviations from desired locations are repeated on adjacent pixel areas. The RIP or other type of processor 16 converts the image data to a pixel-mapped image page image for printing. During printing operation, a recording medium 19 is moved relative to printhead 12 by means of a plurality of transport rollers 22 which are electronically controlled by transport control system 21. A logic controller 17, preferably micro-processor based and suitably programmed as is well known, provides control signals for cooperation of transport control system 21 with the ink pressure regulator 20 and stimulation controller 18. The stimulation controller 18 comprises a droplet controller that provides the drive signals for ejecting individual ink droplets from printhead 12 to recording medium 19 according to the image data obtained from an image memory forming part of the image processor 16. Image data may include raw image data, additional image data generated from image processing algorithms to improve the quality of printed images, and data from drop placement corrections, which can be generated from many sources, for example, from measurements of the steering errors of each nozzle in the printhead 12 as is well-known to those skilled in the art of printhead characterization and image processing. The information in the image processor 16 thus can be said to represent a general source of data for drop ejection, such as desired locations of ink droplets to be printed and identification of those droplets to be collected for recycling.

It may be appreciated that different mechanical configurations for receiver transport control may be used. For example, in the case of a page-width printhead, it is convenient to move recording medium 19 past a stationary printhead 12. On the other hand, in the case of a scanning-type printing system, it is more convenient to move a printhead along one axis (i.e., a main-scanning direction) and move the recording medium along an orthogonal axis (i.e., a sub-scanning direction), in relative raster motion.

Drop forming pulses are provided by the stimulation controller 18 which may be generally referred to as a droplet controller and are typically voltage pulses sent to the printhead 12 through electrical connectors, as is well-known in the art of signal transmission. However, the types of pulses, such as optical pulses, may also be sent to printhead 12, to cause printing and non-printing droplets to be formed at particular nozzles, as is well-known in the inkjet printing arts. Once formed, printing droplets travel through the air to a recording medium and later impinge on a particular pixel area of recording medium or are collected by a catcher as will be described.

Figure 2:
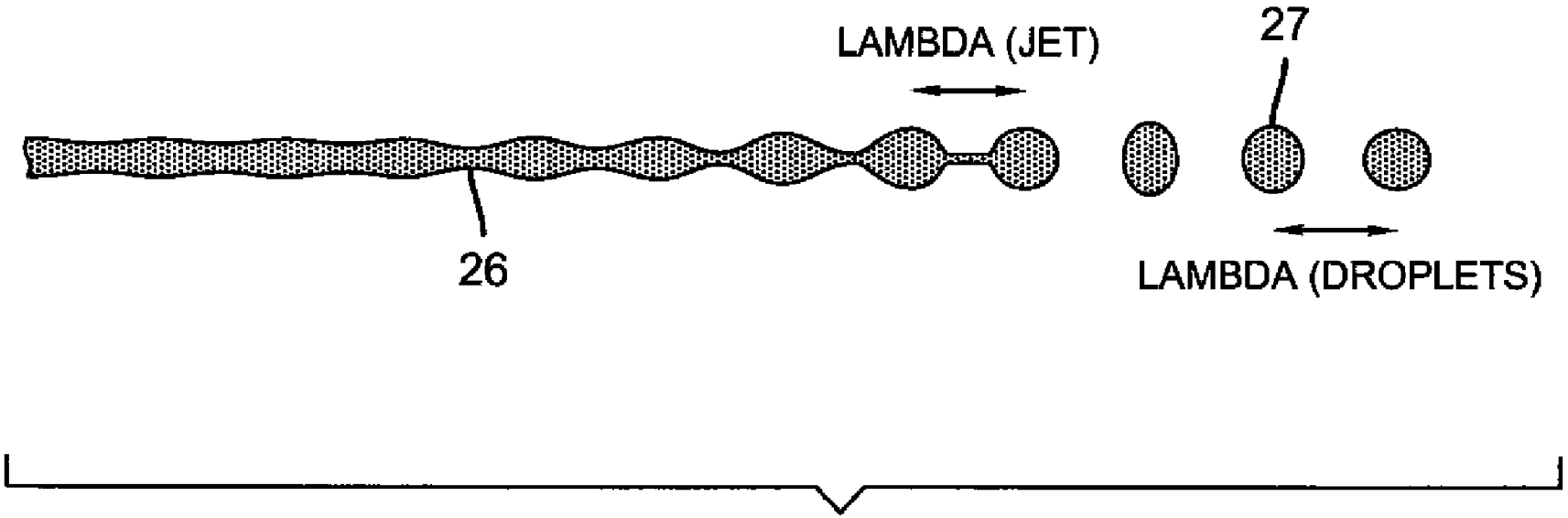
FIG. 2 is an illustration of a jet stream emanating from a nozzle of the continuous inkjet system of FIG. 1 and illustrating the definition of the wavelength, $\lambda$.

With reference now to FIG. 2 the printhead has associated with it, a drop generator that is operable to produce from an array of nozzles liquid jets 26, which break up into ink droplets 27 through the action of stimulation devices. The creation of the droplets is associated with an energy supplied by the stimulation device operating at a frequency that creates droplets separated by the distance $\lambda$, (each value of $\lambda$ is diagrammed by a line with two arrowheads). The stimulation for the liquid jet in FIG. 2 is controlled independently by a stimulation device associated with each liquid jet or nozzle. In one embodiment, the stimulation device comprises one or more resistive elements adjacent to the nozzle. In this embodiment, the liquid jet stimulation is accomplished by sending a periodic current pulse of arbitrary shape, supplied by the stimulation controller through the resistive elements surrounding each orifice of the droplet generator. The break off time of the droplet for a particular inkjet can be controlled by at least one of the amplitude or duty cycle, of the stimulation pulse to the respective resistive elements surrounding a respective resistive nozzle orifice. In this way, small variations of either pulse duty cycle or amplitude allow the droplet break off times to be modulated in a predictable fashion within ±one-tenth the droplet generation period. As the fluid in the liquid jet move a distance $\lambda$ every drop generation period, these small variations of either pulse duty cycle or amplitude produce changes in the break off length, the distance from the orifice at which a droplet separates from the liquid jet in a predictable fashion to within $1/10$ of a distance $\lambda$.

In accordance with one aspect of the invention the ability to selectively charge droplets is dependent upon the creation of a jet break off time differences of less than one stimulation period. Unlike the art described by Vago et al., there is not a need to locate the droplet breakoff points in an electric field having a strong spatial gradient. As a result the system is much more robust than that described by Vago et al.

Figure 3A:
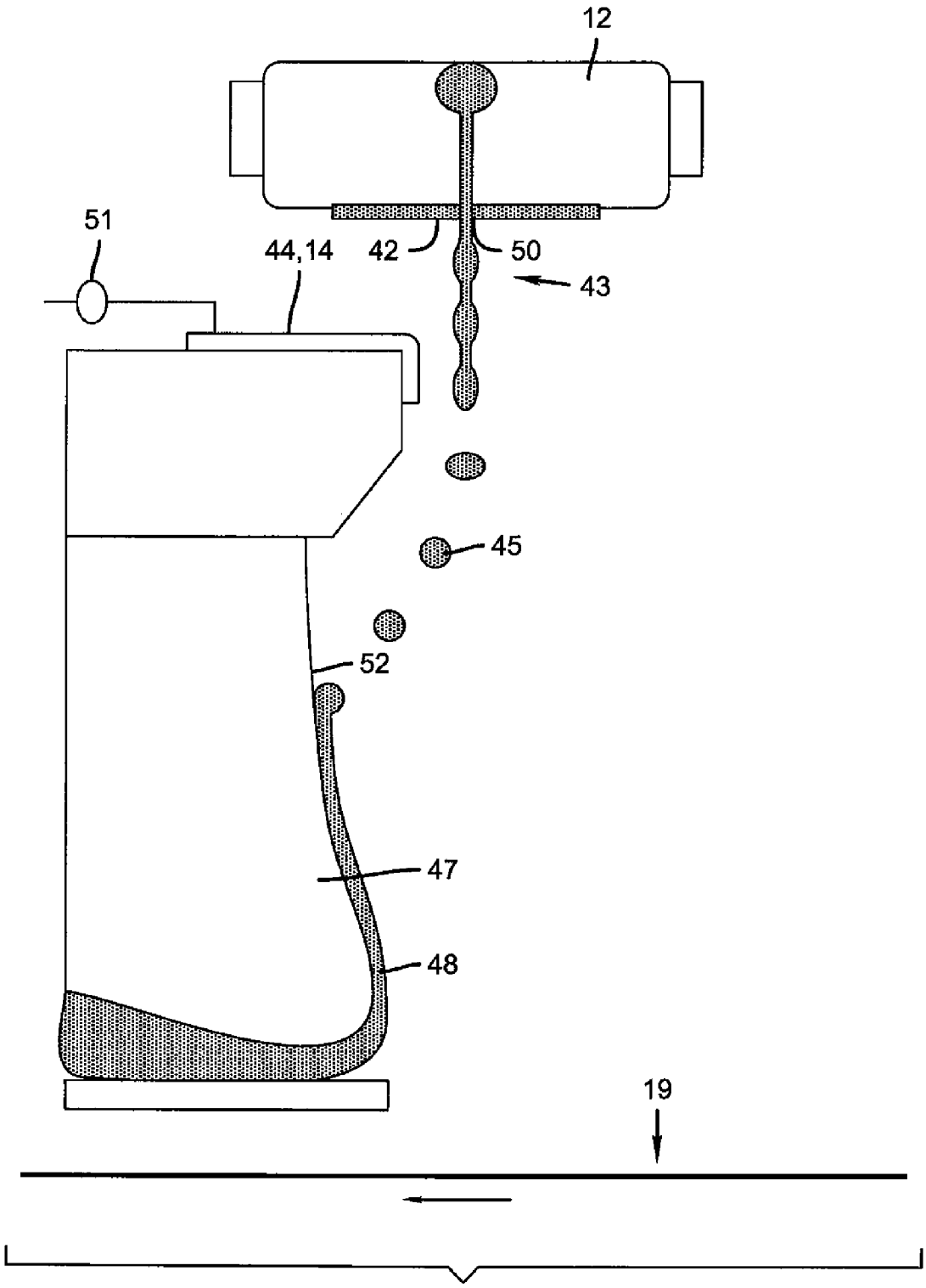
FIGS. 3A and 3B illustrate respectively a cross-sectional viewpoint through a single liquid jet of the continuous inkjet system and illustrating droplets that are charged by a charge electrode and attracted to the catcher and are not printed (FIG. 3A) and droplets that are not charged by a charge electrode and are not attracted to the catcher and are printed (FIG. 3B).
Figure 3B:
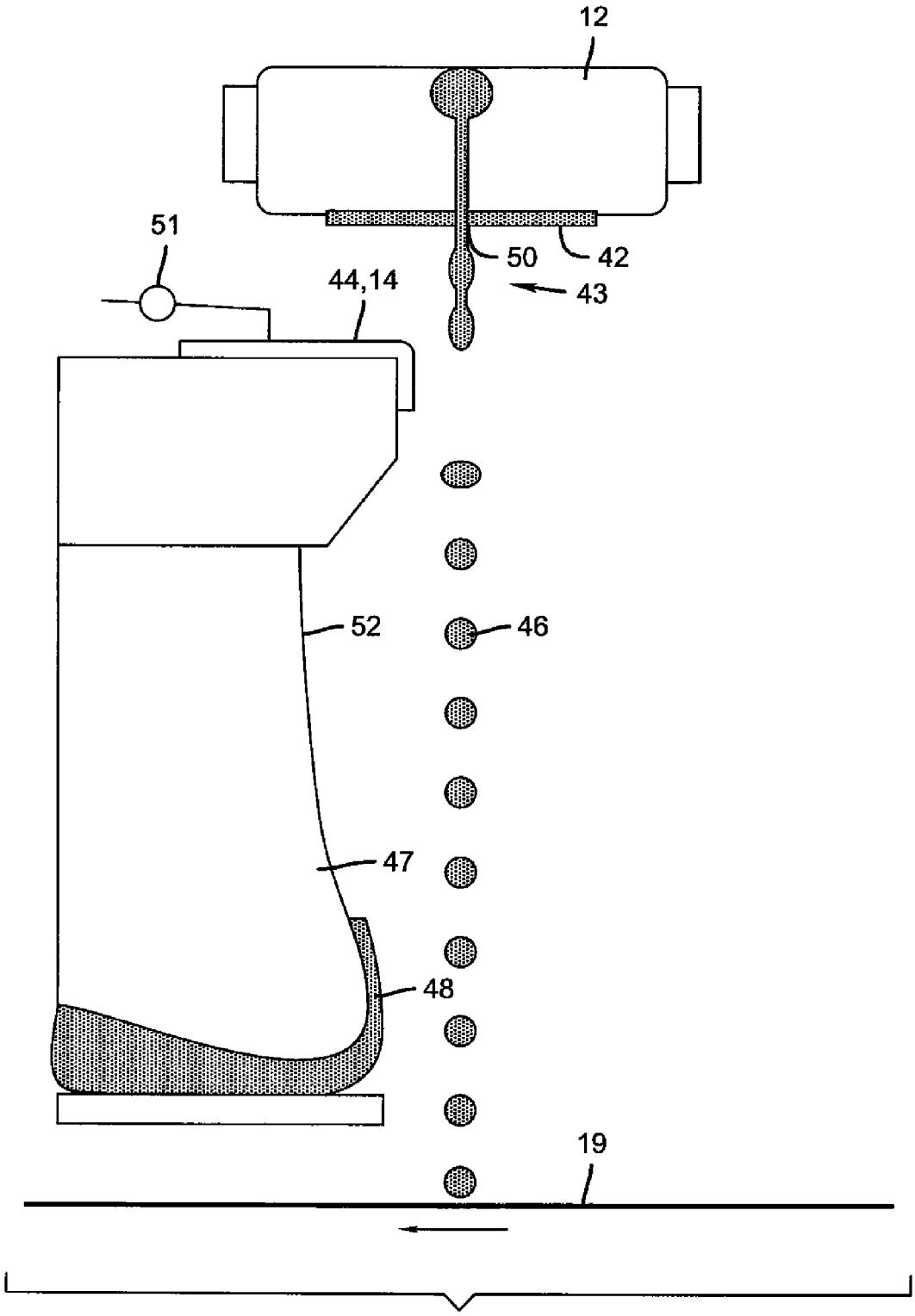

With reference now to FIGS. 3A and 3B, wherein the printhead 12 droplet generator or stimulation device 42 creates a liquid jet 43 that breaks up into ink droplets. Selection of droplets as print droplets 46 or non-print droplets 45 will depend upon the phase of the droplet break off relative to the charge electrode voltage pulses that are applied to the to the charge electrode 44 that is part of the deflection mechanism 14, as will be described below. The charge electrode 44 is variably biased by a charging pulse source 51. The charging pulse source 51 provides a sequence of charging pulses that is periodic with a fixed frequency. The charging pulse train preferably comprises rectangular voltage pulses having a low level that is grounded relative to the printhead 12, and a high level biased sufficiently to charge the droplets as they break off. An exemplary range of values of the electrical potential difference between the high level voltage and the low level voltage is 50 to 200 volts and more preferably 90 to 150 volts. When a relatively high level voltage or electrical potential is applied to the charge electrode 44 and a droplet breaks off from the liquid jet 43 in front of the charge electrode 44 (as shown in FIG. 3A), the droplet acquires a charge and is deflected by a deflection means towards the catcher 47. Droplets that strike the catcher face 52 form an ink film 48 on the face of the catcher. Deflection occurs when droplets break off the liquid jet while the potential of the charge electrode or electrode 44 is provided with a voltage or electrical potential having a non-zero magnitude. The droplets will then acquire an induced electrical charge that remains upon the droplet surface. The charge on an individual droplet has a polarity opposite that of the charge electrode and a magnitude that is dependent upon the magnitude of the voltage and the capacity of coupling between the charge electrode and the droplet at the instant the droplet separates from the liquid jet. This capacity of coupling is dependent in part on the spacing between the charge electrode and the droplet as it is breaking off. Once the charged droplets have broken away from the liquid jets, the droplets will travel in close proximity to the catcher face 52 which is typically constructed of a conductor or dielectric. The charges on the surface of the droplet will induce either a surface charge density charge (for the catcher constructed of a conductor) or a polarization density charge (for the catcher constructed of a dielectric). The induced charges in the catcher will have a distribution identical to a fictitious charge (opposite in polarity and equal in magnitude) in the distance in the catcher equal to the distance between the catcher and the droplet. These induced charges in the catcher are known in the art as an image charge. The force exerted on the charged ink droplet by the catcher face is equal to what would be produced by the image charge alone and causes the charged droplets to deflect and thus diverge from its path and accelerate along a trajectory toward the catcher face at a rate proportional to the square of the droplet charge and inversely proportional to the droplet mass. In this embodiment the charge distribution induced on the catcher comprises a portion of the deflection mechanism. In other embodiments, the deflection mechanism can include one or more additional electrodes to generate an electric field through which the charged droplets pass so as to deflect the charged droplets. For example, a single biased electrode in front of the upper grounded portion of the catcher can be used as shown in U.S. Pat. No. 4,245,226, or a pair of additional electrodes can be used as shown in U.S. Pat. No. 6,273,559

In the alternative and as illustrated in FIG. 3B, when the liquid jet is operable such that the break off point occurs when the electrical potential of the charge electrode 44 is at a relatively low level or zero the droplet does not acquire a charge, travels along a trajectory which is generally on an undeflected path, and impacts the print substrate 19 as a print droplet 46.

Figure 4A:
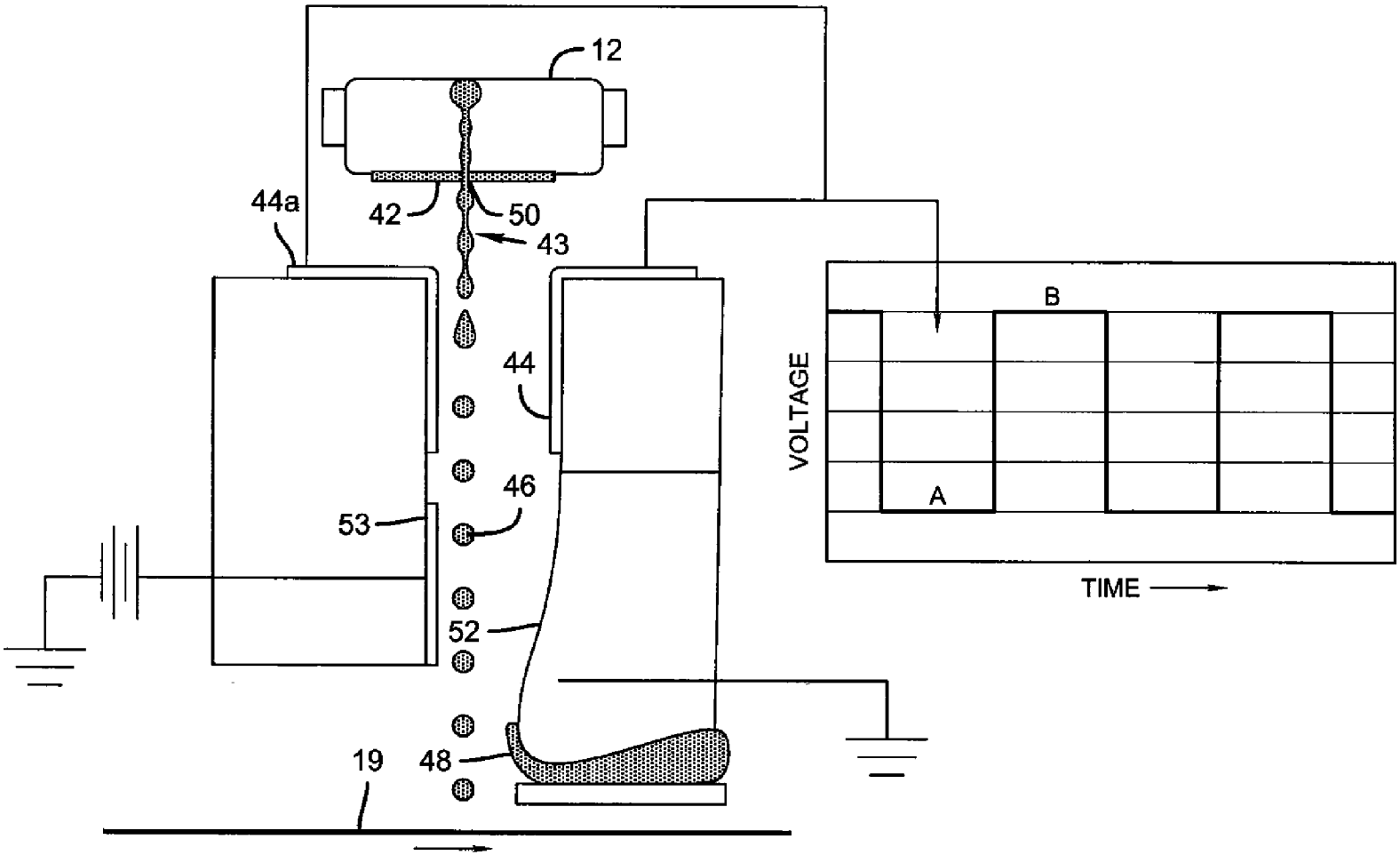
FIG. 4A illustrates another embodiment of a continuous inkjet system of the invention and showing a charge electrode that employs a counter-electrode and also illustrating one voltage or electrical potential phase of the charge electrode wherein the droplets are not charged and are printed.
Figure 4B:
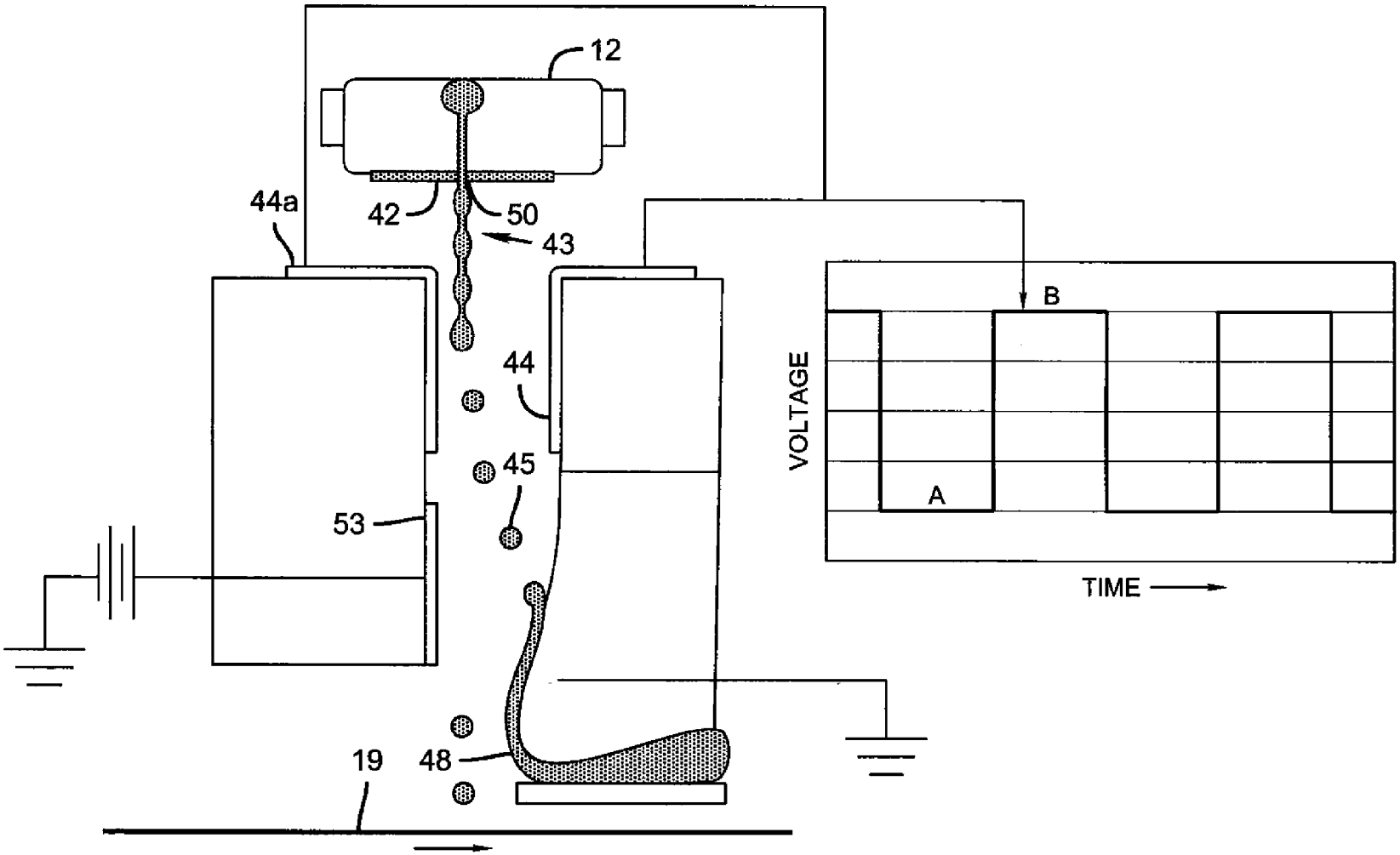
FIG. 4B illustrates the embodiment of FIG. 4A and showing a charge electrode that employs a counter-electrode and illustrates a second voltage or electrical potential phase of the charge electrode wherein the droplets are charged and are attracted to the catcher and are not printed.

FIGS. 4A and 4B illustrate a similar operation to that described with regard to FIGS. 3A and 3B except that in this embodiment the deflection mechanism also includes a second charge electrode 44*a* located on the opposite side of the jet array from the charge electrode 44. This second charge electrode 44*a* receives the same charging pulses from the charge pulse source 51 as the charge electrode and is constantly held at the same potential as the charge electrode 44. The addition of a second charge electrode biased to the same potential as the charge electrode 44 produces a region between the charging electrodes 44 and 44*a* with a very uniform electric field. Placement of the droplet breakoff points between these charge electrodes makes the droplet charging and subsequent droplet deflection very insensitive to the small changes in breakoff position relative to the charging electrodes or in the electrode geometries. This configuration is therefore much more suitable for use with printheads having long arrays of nozzles. The deflection mechanism also includes a deflection electrode 53. The voltage potential between the biased deflection electrode 53 and the catcher face produces an electric field through which the droplets must pass. Charged non-print droplets 45 are deflected by this electric field and strike the catcher face 52. In addition, there is shown in these figures a chart illustrating the voltage or electrical potential on the charge electrode 44 and second charge electrode 44*a* at the respective times when a droplet breaks off in FIGS. 4A and 4B. As will be shown more clearly below, the periodicity of the electrical potential on the charge electrode is synchronized with the pulse stimulation signals to the stimulation device 42 at each nozzle.

Figure 5:
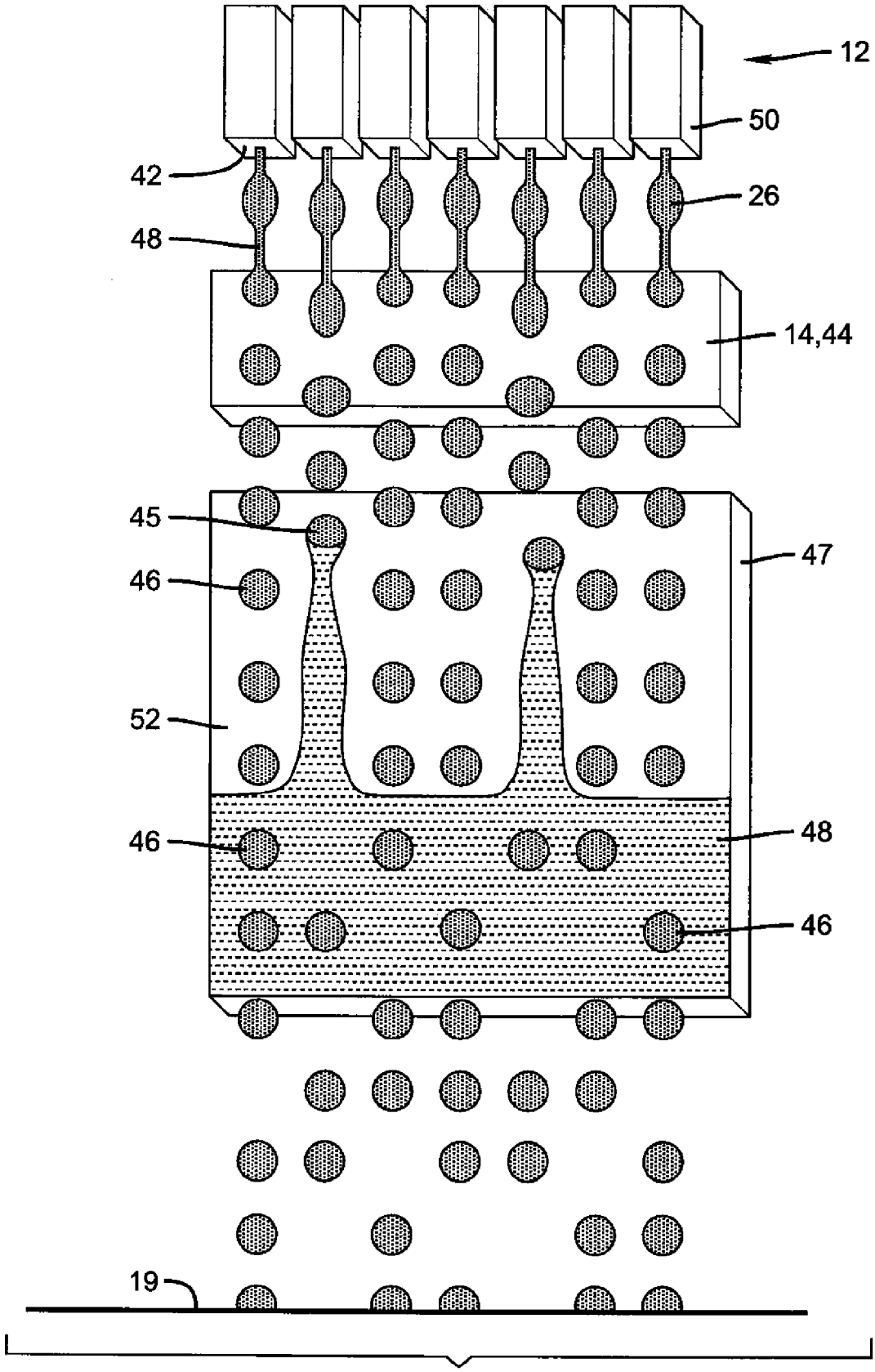
FIG. 5 illustrates a frontal viewpoint of several liquid jets of the continuous inkjet printing system of the invention.
Figure 6:
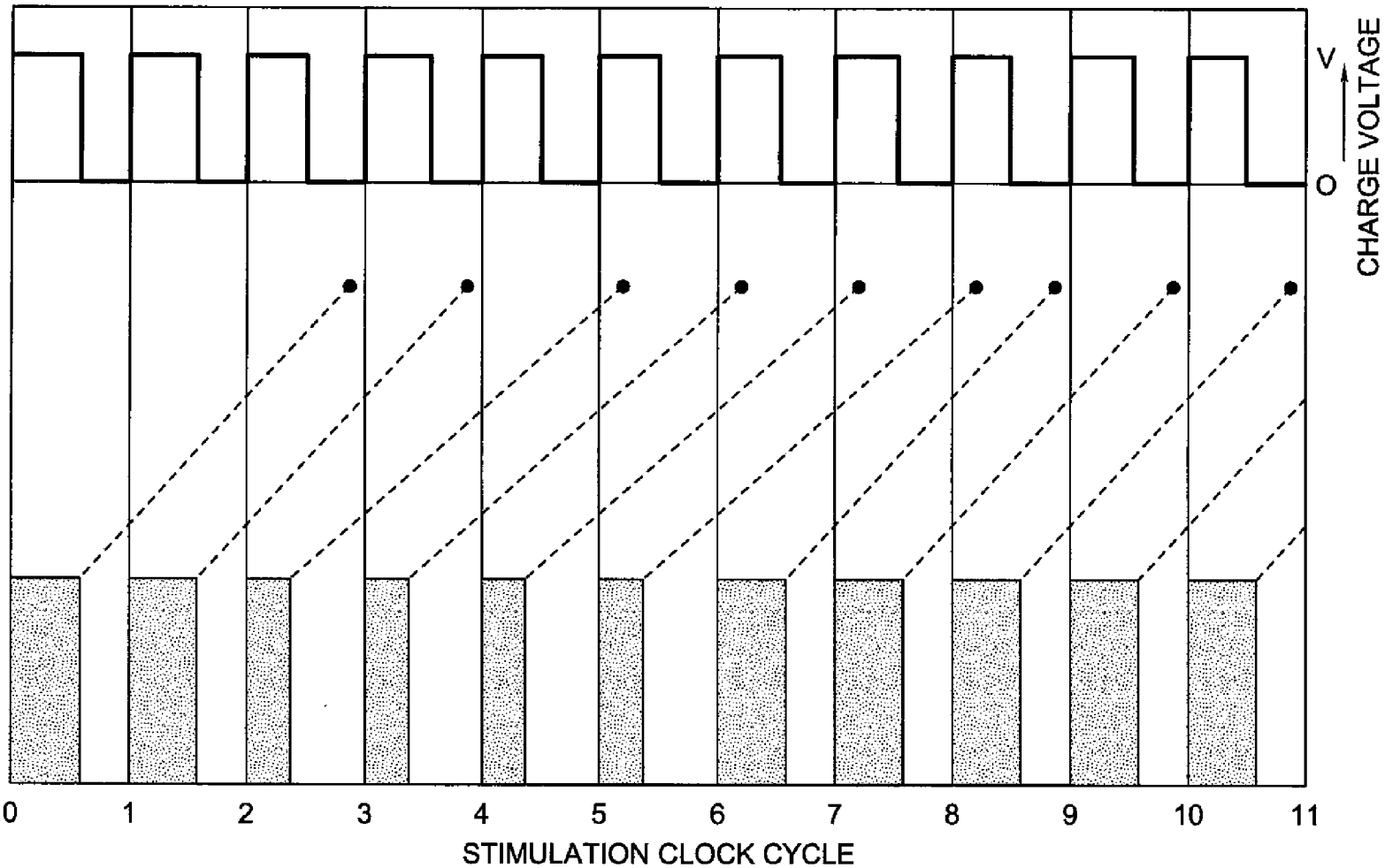
FIG. 6 is a chart illustrating stimulation clock pulses applied to a heater at a nozzle of the CIJ printing system of the invention and corresponding relative locations in time of the break off points of a respective droplet formed by its respective stimulation generating pulse. The chart also illustrates a time changing voltage V that is applied to a charge electrode.

FIG. 5 illustrates a frontal view point of the CIJ printing system of the present invention along with several liquid jets. As shown previously, the printhead 12 has a drop generator 42 that creates a liquid jet 43 from each nozzle 50. The liquid jets 43 break up into droplets in front of charge electrode 44. A common charge electrode 44 may be used for all jets in the array, unlike prior art systems in which the charge electrode potential had to be individually controlled for each jet to control the creation of print and non-print droplets from each nozzle. Those droplets that break off from the liquid jets when the voltage or electrical potential on the charge electrode 44 is relatively high will induce a charge onto those droplets 45 (as in jets #2 and #5 from left-to-right) while droplets from all other liquid jets remain uncharged. The uncharged droplets 46 travel past the charge electrode 44 and catcher face 52 of catcher 47 to impact onto the print substrate or recording medium 19. Charged droplets 45 will be deflected toward the catcher face 52 and create an ink film 48 on the face 52 of the catcher 47 and migrate downward toward the area for recycling. As seen in FIG. 6 the charge electrode 44 extends in a direction transverse to the jet streams so as to be common to and operative to charge droplets from at least a multiple number of these jet streams.

Because droplets break off either when the charge electrode is at a relatively high electrical potential or at a relatively low electrical potential a charge differential is therefore produced between the first liquid droplets having a first breakoff phase and the second liquid droplets having a second break off phase. As a result of the charge differential, the deflection mechanism causes the first and second paths or trajectories of the first liquid droplets and the second liquid droplets, respectively to diverge. For descriptive simplicity, the term uncharged droplets is used in this specification for the droplets with significantly less charge.

It should be obvious, in view of the above description of the invention, to one skilled in the art that the charged droplets are not required to be the non-print droplets. Thus, the charged droplets may be the droplets that are printed while the non-charged droplets are the ones collected by the catcher. This is accomplished by positioning the catcher to intercept the path of the uncharged droplets rather than the path of the charged droplets.

Figure 7:
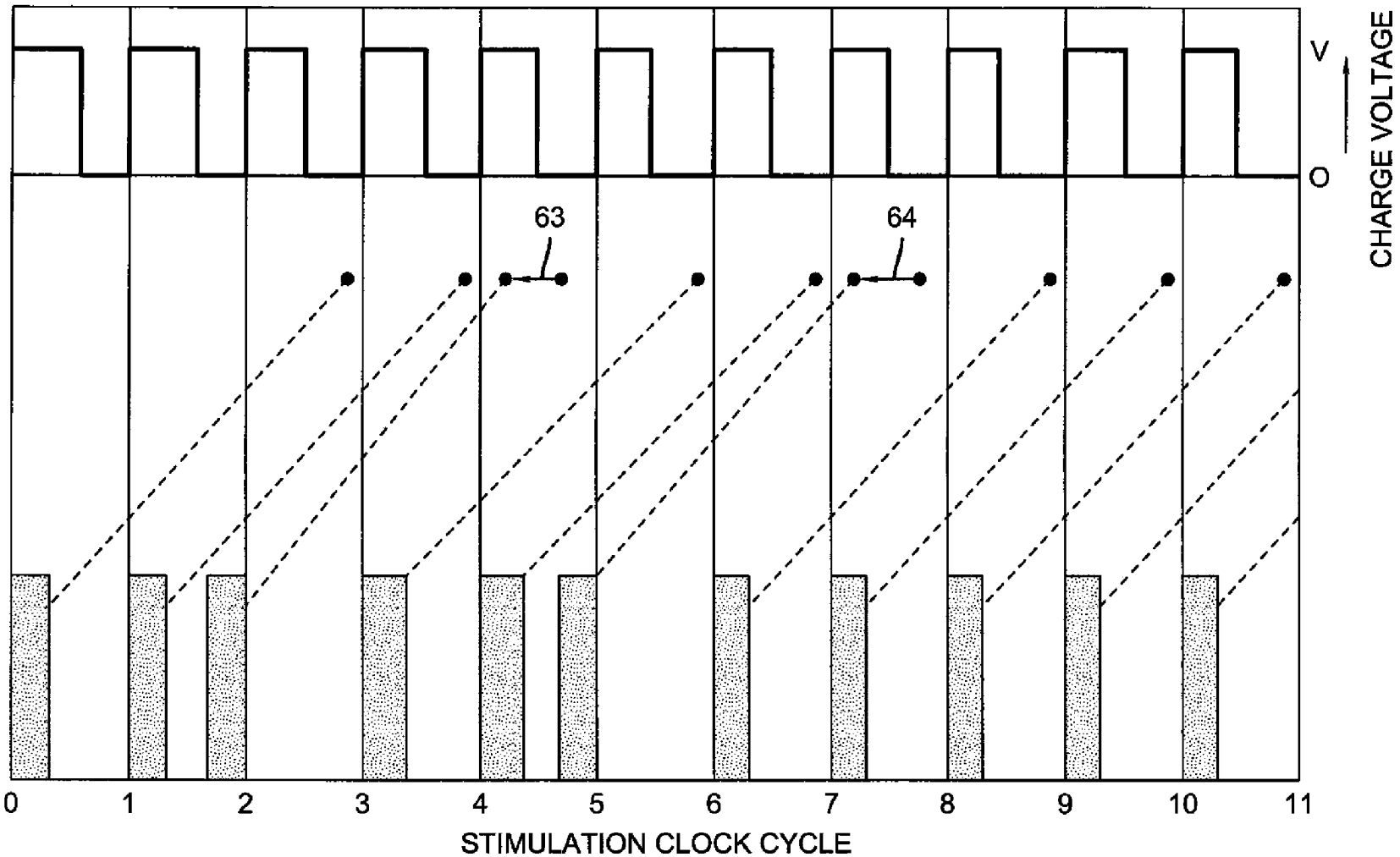
FIG. 7 is a chart similar to that of FIG. 6 but showing a different stimulation pulsing scheme in accordance with the invention.

With reference now to the chart of FIG. 6 there is illustrated schematically stimulation clock cycles for stimulating a nozzle to eject respective droplets. As may be seen between stimulation clock cycles 0-1, a relatively long-duration stimulation pulse at the nozzle heater creates a short break off length droplet at the nozzle indicated by the diamond that is associated by the dotted line connection to the pulse. The location of the diamond identifies the approximate break off time of that droplet associated with that stimulation pulse. Similarly, during stimulation clock cycle between 1-2 a relatively long-duration stimulation pulse at the nozzle heater creates a short break off length droplet at the nozzle. At stimulation clock cycles 2-3, 3-4, 4-5 and 5-6 respective relatively short duration stimulation pulses at the nozzle heater generate respective long break off length droplets indicated by the respective diamonds connected by their respective dotted lines to the associated stimulation pulses. Also illustrated in FIG. 6 is an indication that a voltage or electrical potential V is applied to the charge electrode 44 and has a pulse periodicity that is synchronized with the various stimulation clock cycles. In this figure it can be seen that those droplets that are formed when the electrical potential on the charge electrode 44 is at or near zero will receive little or no charge when they break off near the charge electrode and thus these droplets will not be deflected towards the catcher but instead will progress in their unaltered path towards the recording medium 19. Additionally, it can also be seen in this figure that those droplets that are formed when the electrical potential on the charge electrode is at a relatively high voltage level (negative or positive) will receive a charge when they break off near the charge electrode and such droplets will be deflected from the path and advance towards and be captured by the catcher and will not be printed. In this way, it can be seen that changes in the duty cycle or the width of the stimulation pulses supplied to a stimulation device associated with a nozzle can be used to selectively control whether the droplet created will be a print or non-print droplet. Similarly changes in the amplitude of stimulation pulses supplied to a stimulation device associated with a nozzle can be used to selectively control whether the droplet created will be a print or non-print droplet. In both of these cases (changing the duty cycle or the stimulation pulses or the amplitude of the stimulation pulses), the energy of the stimulation pulses are varied producing changes in the breakoff length and phase of the droplets With reference now to the chart of FIG. 7 there are shown stimulation pulses that are all of the same pulse duration but some of the pulses are phase shifted. Thus the stimulation pulse that would normally be between clock cycle period 2-3 has been phase shifted so that two stimulation pulses are applied to a nozzle stimulation device in the stimulation clock cycle period 1-2. The arrow 63 shows that the resulting droplet creation has also been shifted in phase relative to the charge electrode's voltage status so that the droplet when formed will be charged because the voltage status of the charge electrode is at a relatively high voltage level as is illustrated by the voltage pulse that is directly above the respective droplets. A similar phase shifting also occurs as illustrated in the clock cycle period 4-5 and by the arrow 64 showing the resulting droplet creation has also been shifted in phase relative to the charge electrode's voltage status so that the resulting droplet will also be charged. Thus, in this embodiment, the stimulation pulses that are phase shifted so that the resulting droplets are formed while the charge electrode 44 is charged result in droplets that are deflected to the catcher. Those stimulation pulses that are not phase shifted have their droplets formed while the charge electrode 44 is not in a relatively high voltage potential and such droplets are not charged and continue on their path to deposit on the recording medium. In this case, all stimulation pulses have the same pulse width and amplitude and therefore all supply the same amount of energy. In the examples of FIGS. 6 and 7 it can be seen that the periodic time varying voltage signal to the common charge electrodes 44, 44*a* (if both used) is synchronized with stimulation clock cycles but as used herein may be said to be independent of image data that are used to generate the stimulation pulses to the respective stimulation devices of the respective nozzles. Thus, the voltage signal to the common charge electrode during any stimulation clock cycle during printing or recording is not affected by whether or not the stimulation devices associated with respective nozzles receive signals for generating droplets that are to be printed or otherwise deposited upon the recording medium 19 or receive signals for generating droplets that are not to be printed or otherwise deposited upon the recording medium 19 and are collected for recycling.

The stimulation pulse produces a slight wiggle or perturbation in the diameter of the liquid stream so that a portion of the stream is made slightly narrower than normal and another portion is made wider than normal. The perturbation will grow exponentially with time, the narrower section getting even narrower and the wider section getting even wider. The surface tension of the liquid produces a slight pressure difference in the stream causing liquid to move from the narrower region to the wider region. As the liquid stream is moving, the perturbation moves with the liquid stream. As the perturbation grows, eventually the diameter of the narrower region becomes zero and the drop breaks off.

If the initial perturbation amplitude is made larger, by using higher amplitude stimulation pulses or longer stimulation pulses, less time is needed for the perturbation to grow to the point at which the drop breaks off. Therefore the use of longer and shorter stimulation pulses as in FIG. 6 produces two different break off times. In FIG. 7, on the other hand, the stimulation pulses are all the same in terms of amplitude and pulse width. The size of the perturbations produced by these stimulation pulses are all the same, and therefore the time required for the perturbation to grow sufficiently to break off the drops is the same. In FIG. 7, the phase of the stimulation pulses is shifted relative to the charge electrode voltage signal. As a result the phase at which drops break off relative to the charge electrode voltage signal is also shifted.

Thus distinguishing between printed and catcher droplets is essentially provided by break off phase of the droplet vis-à-vis the voltage or electrical potential on the charge electrode(s). In one respect such occurs through a difference in break off lengths of the droplets that translates into a difference in break off time. In another respect it occurs through a difference in non-uniformity in stimulation pulse timing which also has the effect of changing break off time. In either form, the stimulation device is responsive to respective different types of stimulation signals (corresponding to pulses having different pulse amplitude, pulse width or duty cycle, or pulse phase) and is operable to produce a modulation of the liquid jet to selectively control droplet break off relative to the phase of the cyclically varying voltage from the charge pulse source. Thus, by cycling the voltage level to the charge electrode between low and high voltage on every stimulation cycle and independent of the print data, selective charging of droplets may be provided for by controlling timing of the break off of the droplet with the phase of the voltage on the charge electrode.

While the invention has been described with reference to printing systems and methods it is also known to use inkjet droplet generating devices for decorating pastries and other three-dimensional articles or for forming three-dimensional articles by building up droplets of material on a substrate. The term ink in this application is therefore not limited to colored liquids for printing on paper, but is intended to also refer to liquids appropriate to other such applications. In addition while the stimulation pulses have been illustrated as a single rectangular pulse being provided during each cycle other waveforms can be employed, such as bursts of pulses, ramped pulses, sinusoidal pulses, and pulses of various polarities can also be used dependent on the type of stimulation device. While in the embodiments described the stimulation devices have comprised resistive elements, other types of drop stimulation including optical, piezoelectric, MEMS actuator, electrohydrodynamic, etc. or combinations thereof also may be substituted. Such applications and substitutions are all contemplated by this invention. The stimulation controller may be remote from the stimulation device, or it may be fabricated along with the stimulation device on a common component such as a nozzle plate. While the catcher shown in the illustrations is a Coanda type catcher, other catcher types, such as a knife edge catcher can also be employed. The cyclically varying charge voltage supplied to the charge electrode(s) has been shown as a square wave having a 50% duty cycle, but other cyclically varying waveforms can also be employed such as having pulses with duty cycles greater or less than 50% or having non-zero rise and fall times. As noted above there is the advantage with the invention of use of a common charge electrode with plural nozzles. It will be understood that this does not limit the invention to all nozzles of a printhead being associated with one charge electrode. Thus, as an example only and not by way of limitation, a charge electrode may be associated with for example a set of 50 nozzles of the printhead and another charge electrode may be associated with a different set of 50 nozzles of that printhead.

The invention has been described in detail with particular reference to certain preferred embodiments thereof, but it will be understood that variations and modifications can be effected within the scope of the invention.

PARTS LIST

10 Continuous Inkjet Printing System
11 Ink Reservoir
12 Printhead
13 Image Source
14 Deflection Mechanism
15 Ink Recycling Unit
16 Image Processor
17 Logic Controller
18 Stimulation controller
19 Recoding Medium
20 Ink Pressure Regulator
21 Transport Control System
22 Transport Rollers
26 Liquid jet
27 Ink Droplets
30 Arrow (Lambda Spacing)
31 Truncated Arrow
35 Droplet
36 Droplet
38 Droplet
39 Droplet
42 Stimulation device Or Drop Generator
43 Liquid jet
44 Charge electrode
**44*a*** Second Charge Electrode
45 Non-Print Droplet
46 Print Droplet Or Uncharged Droplets
47 Catcher
48 Ink Film
49 Droplets
50 Nozzle
51 Charging Pulse Source
52 Catcher Face
53 Deflection electrode
63 Arrow
64 Arrow

The invention claimed is:

1. A continuous inkjet system for selectively depositing liquid droplets upon a surface, the system comprising:

a liquid chamber including a nozzle, the liquid chamber containing liquid under pressure sufficient to produce a liquid jet through the nozzle;

a source of varying electrical potential having a periodicity providing cycles each having a relatively high-voltage phase and a relatively low-voltage phase;

a stimulation device operatively associated with the liquid jet, the stimulation device being responsive to respective different types of stimulation signals and operable to produce a modulation in the liquid jet to selectively control droplet break off relative to phases of the cycle of the source, a first liquid droplet from the liquid jet having a first break off phase relative to a cycle of the source and a second liquid droplet from the liquid jet having a second break off phase relative to a cycle of the source, the first break off phase and the second break off phase having a difference such that the first break off phase coincides with the relatively high-voltage phase and the second break off phase coincides with the relatively low-voltage phase; and a deflection mechanism including a charge electrode electrically connected to the source of varying electrical potential, the charge electrode being operable to produce a charge differential between the first liquid droplet and the second liquid droplet, and the deflection mechanism being operable to cause trajectories of the first liquid droplet and the second liquid droplet to diverge so that a trajectory of one droplet of the first and second liquid droplets causes the one droplet to be directed for collection and prevented from depositing on the surface and a trajectory of the other droplet of said first and second liquid droplets causes the other droplet to be directed for depositing upon the surface and wherein the electrical potential on the charge electrode varies with said periodicity and is independent of types of stimulation signals used to determine whether a droplet is to travel in accordance with the trajectory of the first liquid droplet or the trajectory of the second liquid droplet.

2. The continuous inkjet system of claim 1 wherein the stimulation device comprises a stimulation device from the group consisting of thermal, piezoelectric, MEMS actuator, electrohydrodynamic, and optical devices or combinations thereof.

3. The continuous inkjet system of claim 1 wherein the deflection mechanism further comprises at least one deflection electrode to deflect charged droplets.

4. The continuous inkjet system of claim 1, further comprising:

a catcher positioned to intercept the trajectory of said one droplet.

5. The continuous inkjet system of claim 1, wherein a difference in break off phase between the first break off phase and the second break off phase is established by providing for different break off lengths of the first and second liquid droplets.

6. The continuous inkjet system of claim 5, wherein the different break off lengths of the first and second liquid droplets are controlled by a control that provides differences in stimulation pulse energy to the stimulation device.

7. The continuous inkjet system of claim 1, wherein a difference in break off phase between the first break off phase and the second break off phase is controlled by a control that provides for phase shifting of stimulation pulse energy to the stimulation device.

8. The continuous inkjet system of claim 1, wherein the deflection mechanism comprises in addition to the charge electrode a second charge electrode on a side opposite of the liquid jet from the charge electrode.

9. The continuous inkjet system of claim 1, wherein the system includes a plurality of nozzles associated with the liquid chamber for producing a respective liquid jet through each nozzle, a respective said stimulation device being associated with a respective each one of said nozzles and each stimulation device is operatively associated with a respective liquid jet, the stimulation device being responsive to respective different types of stimulation signals and operable to produce a modulation in the respective liquid jet to selectively control droplet break off relative to phases of the cycle of the source, a first liquid droplet from the liquid jet of each nozzle having a first break off phase relative to a cycle of the source and a second liquid droplet from the liquid jet of each nozzle having a second break off phase relative to a cycle of the source, the first break off phase and the second break off phase having a difference such that the first break off phase coincides with the relatively high-voltage phase and the second break off phase coincides with the relatively low-voltage phase; and wherein the charge electrode has common association with each of the different liquid jets and is operable with the respective liquid jet of each nozzle to produce a charge differential between the first liquid droplet and the second liquid droplet, and the deflection mechanism is operable to cause trajectories of the first liquid droplet and the second liquid droplet from the respective liquid jet of each nozzle to diverge so that a trajectory of one droplet of the first and second liquid droplets causes the one droplet to be directed for collection and prevented from depositing on the surface and a trajectory of the other droplet of said first and second liquid droplets causes the other droplet to be directed for depositing upon the surface.

10. The continuous inkjet system of claim 9, wherein the liquid droplets are comprised of ink for printing an image upon the surface.

11. A continuous inkjet droplet generating method for selectively depositing liquid droplets upon a surface, the method comprising:

producing a liquid jet through a nozzle;

providing a charge electrode connected to a source of varying electrical potential having a periodicity providing cycles each having a relatively high-voltage phase and a relatively low-voltage phase;

operating a stimulation device associated with the liquid jet to produce a modulation in the liquid jet to selectively control droplet break off relative to phases of the cycle of the source, a first liquid droplet from the liquid jet having a first break off phase relative to a cycle of the source and a second liquid droplet from the liquid jet having a second break off phase relative to a cycle of the source, the first break off phase and the second break off phase having a difference such that the first break off phase coincides with the relatively high-voltage phase and the second break off phase coincides with the relatively low-voltage phase, the charge electrode operating to produce a charge differential between the first liquid droplet and the second liquid droplet; and selectively deflecting droplets to cause trajectories of the first liquid droplet and the second liquid droplet to diverge so that a trajectory of one droplet of the first and second liquid droplets causes the one droplet to be directed for collection and prevented from depositing on the surface and a trajectory of the other droplet of said first and second liquid droplets causes the other droplet to be directed for depositing upon the surface and wherein the electrical potential on the charge electrode varies with said periodicity and is independent of types of stimulation signals used to determine whether a droplet is to travel in accordance with the trajectory of the first liquid droplet or the trajectory of the second liquid droplet.

12. The continuous inkjet droplet generating method of claim 11, wherein a catcher intercepts the trajectory of said one droplet.

13. The continuous inkjet droplet generating method of claim 11, wherein a difference in break off phase between the first break off phase and the second break off phase is established by providing for different break off lengths of the first and second liquid droplets.

14. The continuous inkjet droplet generating method of claim 13, wherein the different break off lengths of the first and second liquid droplets are controlled by a control that provides differences in stimulation pulse energy to a stimulation device associated with the nozzle.

15. The continuous inkjet droplet generating method of claim 11, wherein a difference in break off phase between the first break off phase and the second break off phase is controlled by a control that provides for phase shifting of stimulation pulse energy to a stimulation device associated with the nozzle.

16. The continuous inkjet droplet generating method of claim 11, wherein the liquid jet passes between the charge electrode and a second charge electrode on a side opposite of the liquid jet from the charge electrode.

17. The continuous inkjet droplet generating method of claim 11, wherein a plurality of nozzles produce a respective liquid jet through each nozzle, at each nozzle there is modulation in the respective liquid jet to selectively control droplet break off relative to phases of the cycle of the source, a first liquid droplet from the liquid jet of each nozzle having a first break off phase relative to a cycle of the source and a second liquid droplet from the liquid jet of each nozzle having a second break off phase relative to a cycle of the source, the first break off phase and the second break off phase having a difference such that the first break off phase coincides with the relatively high-voltage phase and the second break off phase coincides with the relatively low-voltage phase;

wherein the charge electrode has common association with each of the different liquid jets and is operable with the respective liquid jet of each nozzle to produce a charge differential between the first liquid droplet and the second liquid droplet; and selectively deflecting droplets to cause trajectories of the first liquid droplet and the second liquid droplet from the respective liquid jet of each nozzle to diverge so that a trajectory of one droplet of the first and second liquid droplets causes the one droplet to be directed for collection and prevented from depositing on the surface and a trajectory of the other droplet of said first and second liquid droplets causes the other droplet to be directed for depositing upon the surface.

18. The continuous inkjet droplet generating method of claim 17, wherein the liquid droplets are comprised of ink for printing an image upon the surface.

19. The continuous inkjet droplet generating method of claim 17, wherein a difference in break off phase between the first break off phase and the second break off phase is controlled by a control that provides for phase shifting of stimulation pulse energy to a stimulation device associated with each nozzle.

20. The continuous inkjet droplet generating method of claim 11, wherein the liquid droplets are comprised of ink for printing an image upon the surface.

* * * * *